US010494154B2

(12) United States Patent
Abohammdan et al.

(10) Patent No.: US 10,494,154 B2
(45) Date of Patent: Dec. 3, 2019

(54) RECEPTACLE AND COVER

(71) Applicant: Walmart Apollo, LLC, Bentonville, AR (US)

(72) Inventors: Tawfeek Abohammdan, Bentonville, AR (US); Timothy Ryan Hodges, Bentonville, AR (US); Megan Baareman, Byron Center, MI (US)

(73) Assignee: WALMART APOLLO, LLC, Bentonville, AR (US)

( * ) Notice: Subject to any disclaimer, the term of this patent is extended or adjusted under 35 U.S.C. 154(b) by 160 days.

(21) Appl. No.: 15/647,544

(22) Filed: Jul. 12, 2017

(65) Prior Publication Data

US 2018/0057222 A1 Mar. 1, 2018

Related U.S. Application Data

(60) Provisional application No. 62/378,844, filed on Aug. 24, 2016.

(51) Int. Cl.
*B65D 1/22* (2006.01)
*B65D 43/02* (2006.01)
(Continued)

(52) U.S. Cl.
CPC ..... *B65D 43/02* (2013.01); *B65D 1/22* (2013.01); *B65D 43/26* (2013.01); *B65D 81/18* (2013.01);
(Continued)

(58) Field of Classification Search
CPC ..... B65D 43/02; B65D 43/26; B65D 81/18; B65D 81/26; B65D 81/263; B65D 1/22
(Continued)

(56) References Cited

U.S. PATENT DOCUMENTS

D158,958 S 6/1950 Hamel
3,410,698 A * 11/1968 Sosin ..... B65D 1/34 426/106
(Continued)

FOREIGN PATENT DOCUMENTS

JP 2000203607 A 7/2000
WO 2016072911 A1 5/2016

OTHER PUBLICATIONS

Notice of Allowance in Design U.S. Appl. No. 29/610,548 dated Jul. 23, 2018; 9 pages.
(Continued)

*Primary Examiner* — King M Chu
(74) *Attorney, Agent, or Firm* — Schmeiser, Olsen & Watts LLP

(57) ABSTRACT

Systems, methods and apparatuses for covering a storage compartment of a receptacle, reducing exposure of items inside the receptacle to the surrounding environment and decreasing the risk of damage or undesirable impacts on the products being transported. The covered receptacle systems, methods and apparatuses not only provide a physical barrier over the exposed opening of the receptacle's storage compartment, but further passively facilitate the removal of the environmental hazards from the receptacle cover, leading the environmental hazard in a direction away from the receptacle. The removal of environmental hazards may be performed by directing the hazard in a direction away from the storage compartment of the receptacle via a downwardly sloping top surface of the receptacle cover.

10 Claims, 7 Drawing Sheets

(51) Int. Cl.
*B65D 43/26* (2006.01)
*B65D 81/18* (2006.01)
*B65D 81/26* (2006.01)

(52) U.S. Cl.
CPC ..... *B65D 81/26* (2013.01); *B65D 81/263* (2013.01); *B65D 2543/00018* (2013.01); *B65D 2543/0049* (2013.01)

(58) Field of Classification Search
USPC ..... 220/212, 216, 781, 783, 789
See application file for complete search history.

(56) References Cited

U.S. PATENT DOCUMENTS

| | | | | |
|---|---|---|---|---|
| D289,825 | S | 5/1987 | Humphries | |
| D297,248 | S | 8/1988 | Barr | |
| 5,012,928 | A * | 5/1991 | Proffitt | B65D 21/0233 206/508 |
| 5,366,107 | A | 11/1994 | Rostkowski | |
| 6,454,115 | B1 * | 9/2002 | Allasia | B65D 43/162 206/540 |
| 7,156,226 | B1 | 1/2007 | Van Sickle | |
| 7,264,135 | B2 | 9/2007 | Savicki et al. | |
| 7,326,428 | B2 | 2/2008 | Weir | |
| 9,216,855 | B2 | 12/2015 | King et al. | |
| 2007/0271948 | A1 | 11/2007 | Grobleben et al. | |
| 2011/0180541 | A1 | 7/2011 | Becklin | |
| 2017/0327279 | A1 * | 11/2017 | Herlin | B65D 21/0219 |

OTHER PUBLICATIONS

"Bins, Totes & Containers | Containers Bulk | Storage Plastic Container," Popscreen.com, accessed on Aug. 12, 2016; 1 page.
"Cambro IBS37—Ingredient Bin—37 Gallon—Slant Top," Zesco.com, accessed on Aug. 12, 2016; 1 page.
"Insertable Bins for Euro Containers," Workplace-Products.co.uk, accessed on May 31, 2017; 5 pages.
"Euronorm Storage Box Set Gray," OBI.at, accessed on May 31, 2017; 3 pages.
"PLASEK4/100—1/4 Insertable Contatiners for 600×400 Economy Range,", Plastor.co.uk, accessed on May 31, 2017; 1 page.
"ESD Insertable Bins," HelloTrade.com, Auer Packaging Gmbh, accessed on May 31, 2017; 4 pages.
"Bar Garnish Tray in Stainless Steel—6 Compartments," BehindTheBar.com, accessed on May 31, 2017; 4 pages.

* cited by examiner

RECEPTACLE AND COVER

CROSS REFERENCE TO RELATED APPLICATIONS

This application claims the priority and benefit of U.S. Application No. 62/378,844 entitled "RECEPTACLE AND COVER" filed Aug. 24, 2016, the contents of which are hereby incorporated by reference.

TECHNICAL FIELD

The present disclosure relates generally to systems, methods and apparatuses for receptacles, receptacle covers and more specifically to embodiments of covered receptacles protecting the covered receptacle's contents from a surrounding environment.

BACKGROUND

With the growth of the Internet, many different types of businesses have begun establishing online systems for transacting business. The online grocery store is one of the fast growing markets in today's Internet age, but is still slowly evolving. One of the hurdles that has limited the initial growth of online accessible grocers is the costs and investments required to support home delivery. As an alternative to home delivery, many grocery stores and other physical retailers are beginning to offer curbside delivery of online selected items to a customer's vehicle when the customer arrives at the store's location.

To facilitate the delivery of the online selected items from the store to the customer's vehicle upon pickup, the items are often collected in carts, baskets, bins or other receptacles prior to the customer arriving. Upon arrival of the customer, the collected items placed inside the grocery carts, baskets or bins are brought outside to the customer's vehicle by one or more staff members of the store. However, the existing carts, baskets or bins are uncovered, leaving the delivered items exposed to environment harm, including harm caused by inclement weather such as rain, snow, wind, etc. during the delivery to the customer waiting in the parking lot. As a result of exposure to the environment, items being delivered may become wet, damaged or dirty. Thus there is a need for a receptacle cover, a covered receptacle system and methods for covering a receptacle, which provide protection to items from inclement weather during transportation and delivery to a customer.

SUMMARY

A first embodiment of the present disclosure provides a covered receptacle system comprising a receptacle having a storage compartment formed by a front sidewall, a rear sidewall and a rim formed along a perimeter of a top of the storage compartment of the receptacle; a receptacle cover comprising a top surface and an undersurface having a first pair of legs and a second pair of legs, wherein the first pair of legs and second pair of legs extend downward from the undersurface of the receptacle cover; the first pair of legs positioned adjacent to the rim at the front sidewall, wherein the first pair of legs extend above the rim; the second pair of legs positioned adjacent to the rim at the rear sidewall, wherein the second pair of legs extend above the rim; and the top surface of the receptacle cover slopes at a downward angle.

A second embodiment of the present disclosure provides a receptacle cover comprising: a top surface; an undersurface; a first pair of legs extending downward from the undersurface at a front edge of the undersurface; and a second pair of legs extending downward from the undersurface at a rear edge of the undersurface, wherein the second pair of legs are shorter in length than the first pair of legs.

A third embodiment of the present disclosure provides a method for covering a receptacle comprising the steps of: providing the receptacle, the receptacle having a storage compartment formed by a front sidewall, a rear sidewall and a rim forming a perimeter along a top of the storage compartment; providing a receptacle cover comprising a top surface, an undersurface, a first pair of legs extending downward from the undersurface and a second pair of legs extending downward from the undersurface, wherein the second pair of legs are shorter in length than the first pair of legs; abutting the first pair of legs against the rim and the front sidewall, wherein the first pair of legs are extending above the rim of the receptacle; and abutting the second pair of legs against the rim and the rear sidewall, wherein the second pair of legs are extending above the rim of the receptacle.

DETAILED DESCRIPTION

Figure 1:
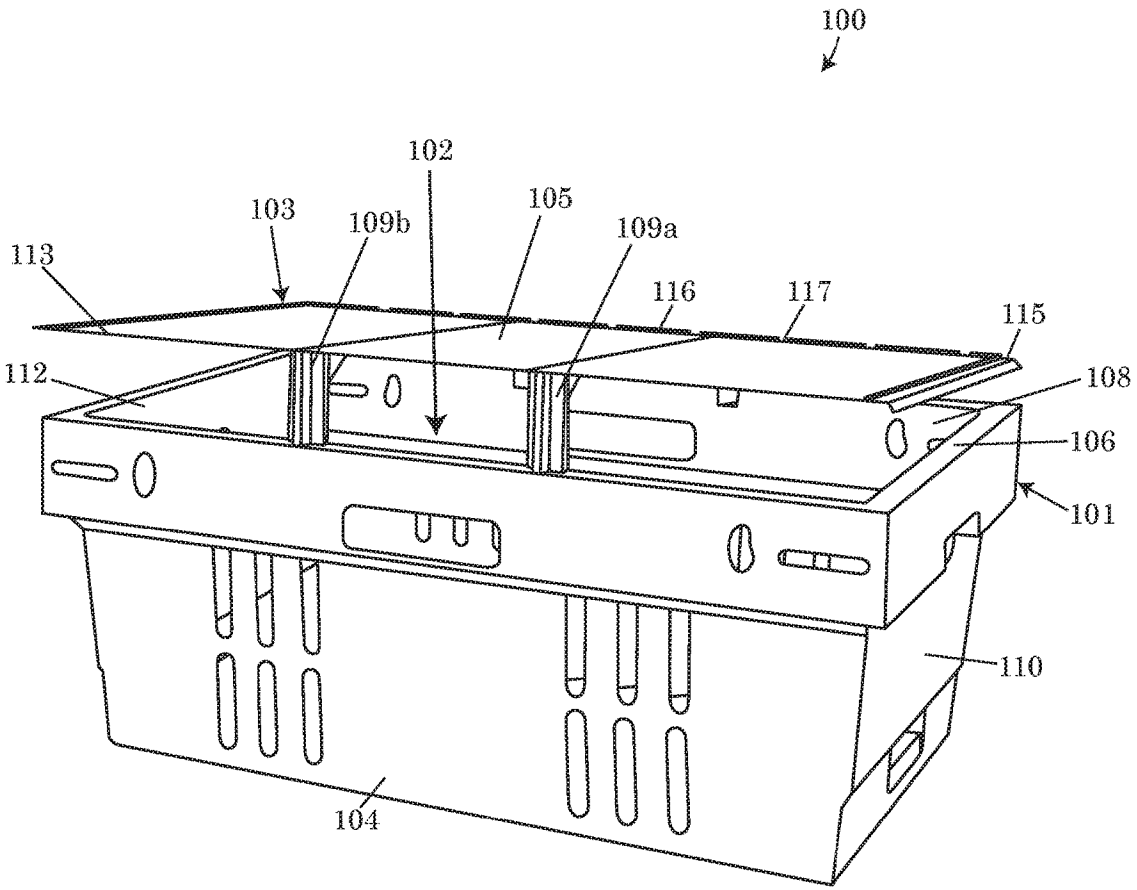
FIG. 1 depicts an isometric front view of an embodiment of a covered receptacle.
Figure 2:
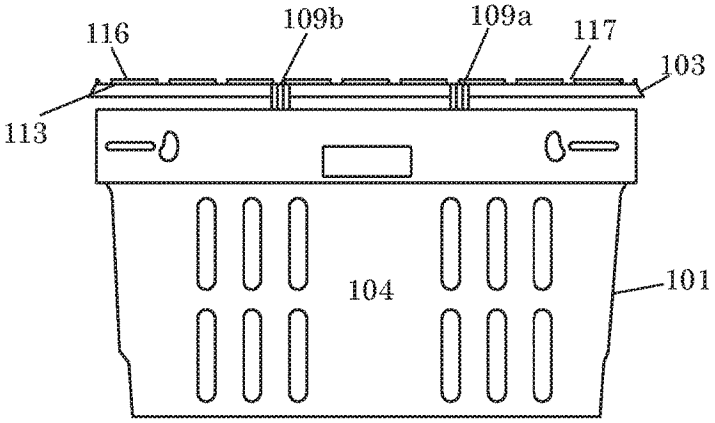
FIG. 2 depicts a front view of the covered receptacle of FIG. 1.
Figure 3:
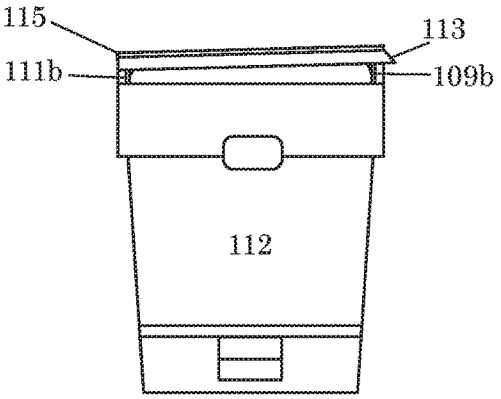
FIG. 3 depicts a left side view of the covered receptacle of FIG. 1.
Figure 4:
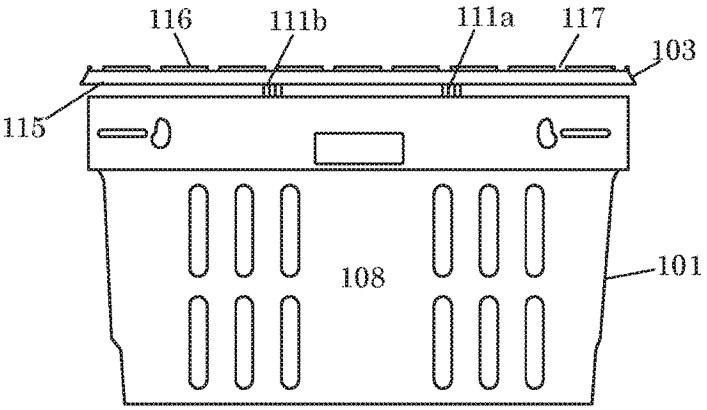
FIG. 4 depicts a rear view of the covered receptacle of FIG. 1.
Figure 5:
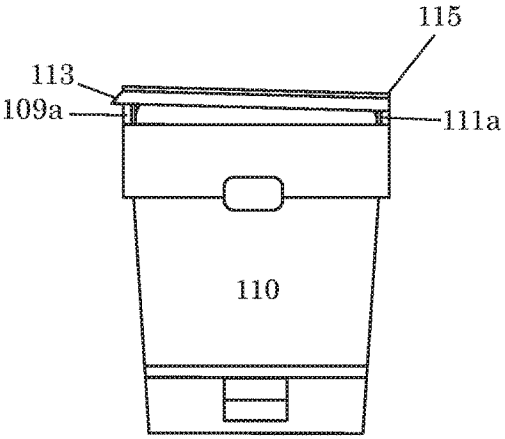
FIG. 5 depicts a right side view of the covered receptacle of FIG. 1.

Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure. A more complete understanding of the present embodiments and advantages thereof may be acquired by referring to the following description taken in conjunction with the accompanying drawings, in which like reference numbers indicate like features.

As a preface to the detailed description, it should be noted that, as used in this specification and the appended claims, the singular forms "a", "an" and "the" include plural referents, unless the context clearly dictates otherwise.

Overview

Embodiments of the present disclosure recognize that the systems, methods and apparatuses currently available for storage and delivery of food or other items from a store, such as a grocery store, do not sufficiently cover or protect the items stored inside the receptacle from the surrounding environment. Instead, stores implement the use of open air receptacles such as grocery carts, baskets, bags, bins or other devices to transport food and other products while inside the store as well as to the vehicles of the customers. Currently available receptacles for transporting and delivering products lack a covering in favor of accessibility to the storage compartment of the receptacle, allowing for the ability to stack quantities of products in a manner that exceeds the boundaries of the receptacle itself.

Embodiments of present disclosure improve the receptacles used for shopping, transportation and delivery of products by introducing systems, methods and apparatuses that cover the storage compartment of the receptacle containing the products, reducing exposure to the surrounding environment, decreasing the risk of damage or undesirable impacts on the products being transported. Embodiments of the covered receptacle systems, methods and apparatuses not only provide a physical barrier over the exposed opening of the receptacle's storage compartment, but the embodiments of the present disclosure actively facilitate the removal of the environmental hazards that may affect the contents of the receptacle, such as water, snow, ice and debris. The removal of environmental hazards may be performed by directing the hazard away from the storage compartment of the receptacle, for example via a sloping surface of the receptacle cover.

Embodiments of the systems, methods and apparatuses of the present disclosure may be versatile, allowing for numerous configurations and uses. The embodiments of the present disclosure, as described below, are capable of being used with multiple receptacle types, including pre-existing, new and custom-designed open air receptacles. The receptacle covers described herein may able to slide on and off the rim and sidewalls of the receptacle allowing for quick and easy installation and removal of the receptacle cover. Embodiments of the receptacle covers may be reversible, allowing for the receptacle covers to be affixed to the receptacle in multiple configurations, both forwards and backwards and the embodiments of the receptacle cover may be height adjustable or varying heights which may allow for customizing the amount of distance available between the receptacle and the receptacle cover.

In some embodiments, the receptacle cover may be stackable on top of one another. Stack-ability of the receptacle covers may allow each of the covers to be removed and held in a clean position, instead of having to hold the receptacle cover or place the cover on the ground while removing the contents of the receptacle's storage compartment. Stack-ability may be particularly useful during delivery of multiple of receptacles full of products to a customer and for maintaining sanitary conditions during food delivery.

Covered Receptacle

Referring to the drawings, FIG. 1 illustrates an embodiment of a covered receptacle system 100. Embodiments of system 100 may comprise a receptacle 101. The receptacle 101 may be identified as any apparatus capable of holding or storing one or more items within a storage compartment 102 of the receptacle 101. Examples of a receptacle 101 may include a bin, cart, container, tote, box, basin, vessel, etc. The receptacle 101 may be constructed out of any rigid or semi-rigid material capable of confining products or other items of physical matter within the storage compartment 102. The material constructing the receptacle 101 may include, but is not limited to examples such as plastic, Styrofoam, metal or metal alloys, paper, wood, cardboard, rubber. In exemplary embodiments, the materials constructing the receptacle 101 may include plastics such as polyethylene terephthalate (PET), high density polyethylene (HDPE), low density polyethylene (LDPE), polyvinyl chloride (PVC), polypropylene, polystyrene, polycarbonate and other polymeric resins known by a person skilled in the art.

Embodiments of the storage compartment 102 of the receptacle 101 may be formed by a plurality of sidewalls 104, 108, 110, 112 affixed or connected to one another. The number of sidewalls 104, 108, 110, 112 may vary depending on the shape of the receptacle 101 constructed. For example, the rectangular receptacle 101 depicted in FIG. 1 includes four sidewalls 104, 108, 110, 112, whereas a receptacle 101 that is triangular in shape may have three sidewalls. Likewise, a receptacle that is pentagon shaped may have five sidewalls, while a hexagon shaped receptacle may have six sidewalls. The shape of the receptacle and the number of side walls may depend on the preferences of the manufacturer or the manufacturer's client who may desire a particular shape.

The storage compartment 102 may be the cavity created by the combination of the plurality of sidewalls 104, 108, 110, 112 placed adjacent to one another and a bottom surface of the receptacle 101, located at the base of the storage compartment 102. The size of the storage compartment 102 may vary in overall size as a function of the length and height of each of the sidewalls 104, 108, 110, 112 placed adjacent to one another. Embodiments of the receptacle 101 may further include a rim 106 which may be defined by the exposed edge of each sidewall 104, 108, 110, 112 defining a perimeter at the top of the storage compartment 102.

In some embodiments, the sidewalls 104, 108, 110, 112 of the receptacle 101, may be formed as a single unit when the receptacle 101 is initially constructed. In alternative embodiments, the sidewalls 104, 108, 110, 112 may be independently constructed and subsequently connected, affixed or fused to each of the remaining sidewalls 104, 108, 110, 112 after each of the side walls 104, 108, 110, 112 have been formed. For example, in some embodiments, the receptacle 101 and the sidewalls 104, 108, 110, 112 forming the storage compartment 102, may be produced using injection molding, thus forming the storage compartment 102, sidewalls 104, 108, 110, 112 and bottom wall as a cohesive whole at the time of formation. In an alternative example, each side wall 104, 108, 110, 112 may be separately constructed from a rigid or semi-rigid material and then subsequently affixed using, for example, an epoxy, glue, staples, fasteners, screws, snap connections, or any other connecting means to combine the sidewalls 104, 108, 110, 112 to one another and the bottom wall of the receptacle 101.

Each of the sidewalls 104, 108, 110, 112 may be identified in accordance with the position or location of the sidewalls 104, 108, 110, 112 creating the storage compartment 102. For example, in the exemplary embodiment of FIG. 1, sidewall 104 may be referred to as the front sidewall because of the sidewall's 104 position closest to the point of view in the drawings. Similarly, sidewall 108 may be referred to as the rear sidewall 108, due to the position of the rear sidewall 108 being located at the rear side of the receptacle 101 when viewed from the perspective of FIG. 1. Accordingly, a person skilled in the art viewing the receptacle from the opposite side of the receptacle's position shown in FIG. 1, may reverse the nomenclature of the front sidewall 104 and the rear sidewall 108.

Still referring to the drawing of FIG. 1, the receptacle 101 may further include a plurality of sidewalls adjacent to the front sidewall 104 and the rear sidewall 108. As shown, the sidewalls 110, 112 may be adjacent to the front sidewall 104 and the rear sidewall 108 at a 90° angle and thus perpendicular to sidewalls 110, 112. In alternative embodiments of the receptacle 101, particularly in embodiments having non-rectangular or non-square shapes, the angle between the front sidewall 104 or rear sidewall 108 and the sidewalls 110, 112 may vary between 0° to 180°. Similar to the labelling of the front sidewall 104 and the rear sidewall 108 in FIG. 1, the sidewalls 110, 112 adjacent to the front sidewalls 104 and rear sidewall 108 may also be identified based on the relative location of the sidewalls 104, 108, 110, 112. For example, using the perspective of the drawing of the covered receptacle 100 in FIG. 1, the sidewall 110 positioned in the right hand side of the drawing may be referred to as the right sidewall 110, while the sidewall 112 may be referred to as the left sidewall 112. Accordingly, a person skilled in the art would recognize that reversing the viewing position of the receptacle 101 may alter the naming of each of the sidewalls 104, 108, 110, 112. For instance, a person skilled in the art who may be viewing the receptacle from the opposite angle than shown in FIG. 1, may reverse the left sidewall 112 and the right sidewall 110.

In some embodiments of the covered receptacle system 100, the receptacle 101 may be configured with a receptacle cover 103. Similar to the receptacle 101, the receptacle cover 103 may also be constructed out of any rigid or semi-rigid material which may be capable of protecting the contents of the receptacle 101 from the surrounding environment. For example, the receptacle 103 may be constructed out of Styrofoam, metal or metal alloys, paper, wood, cardboard, rubber and various type of plastics such as PET, HDPE, LDPE, PVC, polypropylene, polystyrene, polycarbonate and other plastics known by a person skilled in the art. Embodiments of the receptacle cover 103 may constructed and designed from a single piece of starting material or in alternative embodiments, a plurality of sections of the receptacle cover 103 may be combined or affixed to one another to form the various features of the receptacle cover 103 described herein. For example, the plurality of sections of the receptacle cover may be fastened, stapled, glued, epoxied, screwed, snap fitted, interlocked, nailed or welded together.

Embodiments of the receptacle cover 103 may comprise a top surface 105, an undersurface 107, a first plurality of legs 109*a*, 109*b* and a second plurality of legs 111*a*, 111*b*. The top surface 105 of the receptacle cover 103 may be a flat, smooth surface which may have a low friction coefficient. In some embodiments, the top surface may be chemically coated with a friction reducing coating. The top surface may be outwardly exposed to the environmental conditions above the rim 106 of the receptacle 101. The top surface 105 may act primarily as a shield for covering and protecting the contents of the receptacle 101 storage compartment 102. In some embodiments, the dimensions of the top surface 105 may be selected as a function of the receptacle 101, the size of the storage compartment 102 and the perimeter size of the rim 106. In the exemplary embodiment of the receptacle cover 103, the size dimensions of the top surface 105 of the receptacle cover 103 may selected to cover at least the opening of the storage compartment 102 and the rim 106 of the storage compartment 102. In alternative embodiments, the top surface 105 may have a length and width larger than the perimeter of the receptacle 101 defined by the rim 106 or smaller than the receptacle's perimeter defined by the rim 106.

In some embodiments, a receptacle cover 103 constructed from multiple sections of material, may include an expandable top surface 105 that may be adjustable in size. For example, the top surface may comprise a sliding track or overlapping surfaces that may allow the multiple sections of top surface to extend away from one another, increasing the overall size top surface 105. Likewise, a multi-sectioned top surface may also be contracted together, for example, sliding each section of the top surface 105 over the other, or into a hidden section the top surface 105, decreasing the overall size of the top surface 105. In some embodiments, upon sliding the sections of the top surface apart, a gap may be created allowing for additional section of material to be inserted, increasing the size of the top surface 105. Alternatively, in some embodiments, sections of the top surface 105 may be removed and the remaining sections of the top surface 105 may be contracted together to close a gap that may have formed upon removal of one or more sections of top surface 105 material.

Embodiments of the top surface 105 may be slanted in a downward sloping direction, at an angle greater than 0° and less than 180°. The sloped direction of the top surface 105 may be particularly useful for directing un-desired or harmful environmental matter from coming in contact with the contents placed inside the storage compartment 102. The environmental matter, such as water, snow, dirt and debris making contact with the top surface 105 may slide down the top surface's 105 slanted, smooth and low friction surface in the direction from the front edge 113 to the rear edge 115 of the top surface 105. As the environmental matter travels down the top surface in the direction of the front edge 113 to the rear edge 115, upon reaching the rear edge, the environmental matter may remove itself from the top surface, falling outside of the storage compartment and onto the surrounding environment.

In some embodiments, the top surface 105 of the receptacle cover 103 may further comprise a raised edge 116. As shown in the exemplary embodiments of the drawings, the raised edge 116 may extend at an upward angle from the top surface 105. Embodiments of the raised edge 116 may protrude from the top surface 105 at an angle perpendicular to the top surface 105. Embodiments of the raised edge 116 may be present along one or more edges of the perimeter of the top surface 105. For example, the raised edge 116 may be present along each edge of the top surface 105, forming a raised edge 116 around the entire perimeter of the top surface 105. In alternative embodiments, the raised edge 116 may be present on the front edge 113, rear edge 115, and/or either side edges of the top surface 105 that may be adjacent to the front edge 113 and/or rear edge 115. In the exemplary embodiment of FIG. 1, the top surface 105 is depicted as having a raised edge located on the rear edge 115 and both side edges perpendicular to the rear edge 115.

Figure 12:
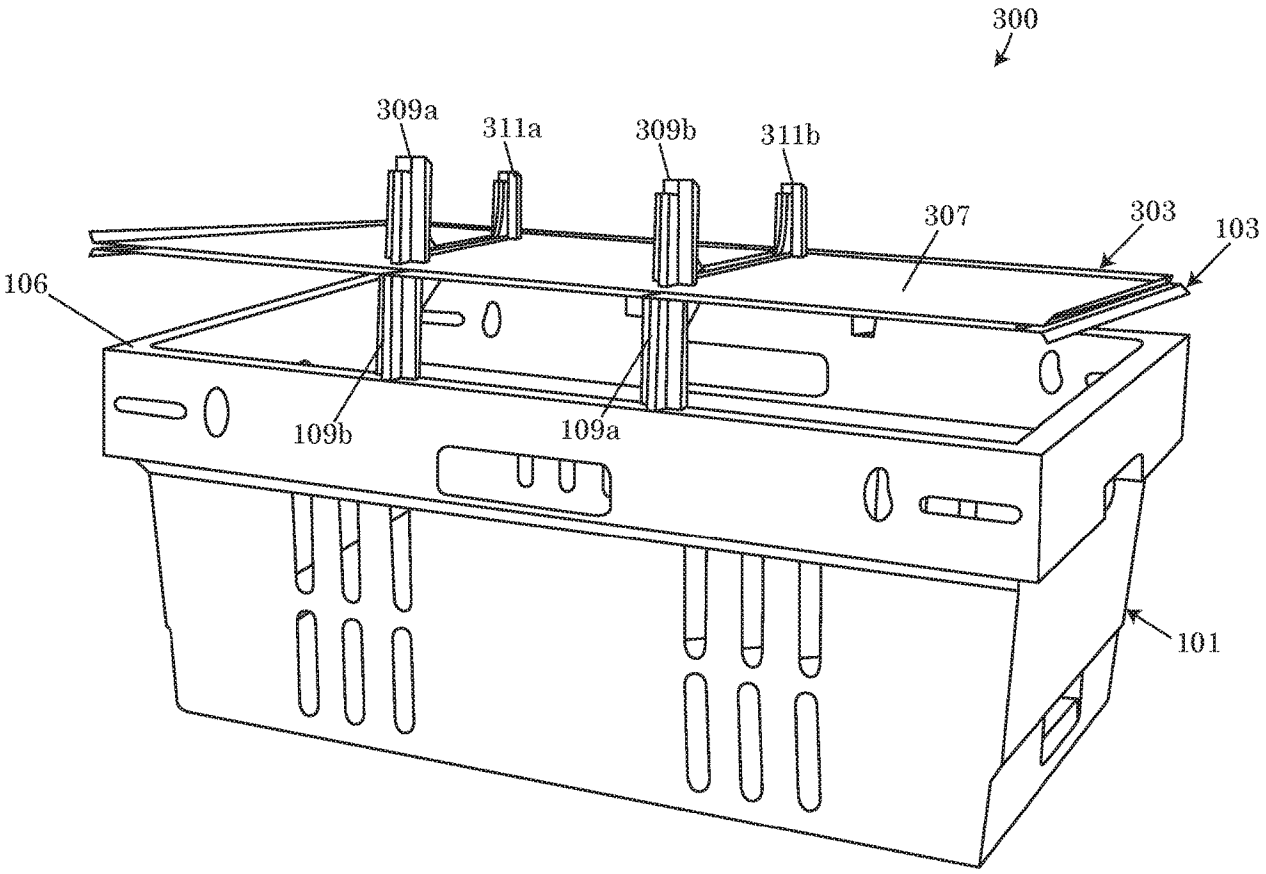
FIG. 12 depicts a front isometric view of an embodiment of a covered receptacle having a second receptacle cover stacked thereon.
Figure 13:
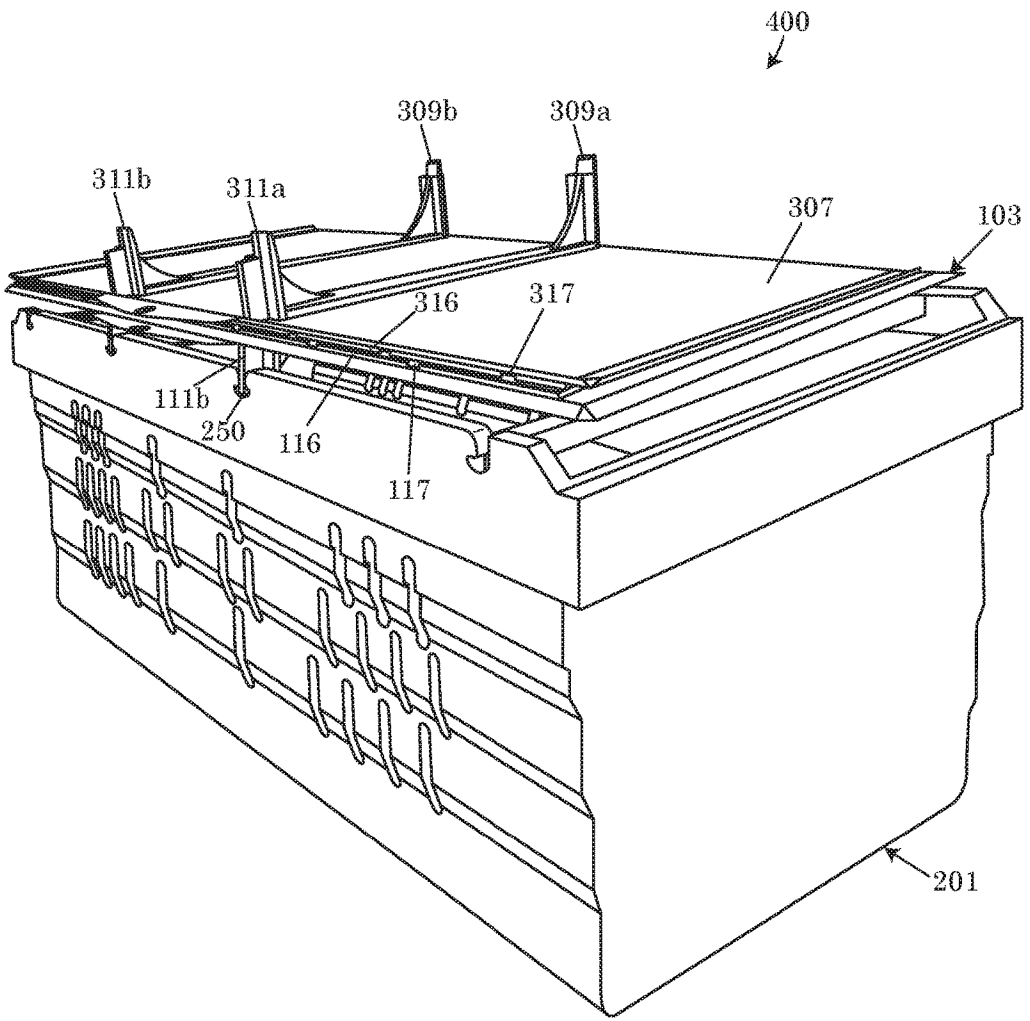
FIG. 13 depicts a rear isometric view of an alternative embodiment of a covered receptacle having a second receptacle stacked thereon.

The raised edge 116 of the receptacle cover 103 may provide a supportive surface capable of stabilizing and securing a second receptacle cover 303 placed on top of the receptacle cover 103. As shown in FIGS. 12 and 13, the receptacle covers 103, 303 may be stackable upon one another. For example, the second receptacle cover 303 may have the top surface of the second receptacle cover 303 inverted and placed onto top surface 105, while the undersurface 307 and legs 309*a*, 309*b*, 311*a*, 311*b* are facing in an upward direction. The raised edge 116 of the first receptacle cover 103 and the raised edge 316 of the second receptacle cover 303 may abut against each other to provide support and restrict the amount of movement of the inverted second receptacle cover 303, as shown by the example of FIG. 13. To further increase friction and prevent movement of either stacked receptacle covers 103, 303, the raised edges 116, 316 may be coated in a material that may increase friction, for example a rubberized coating.

In some embodiments, either or both the first receptacle cover 103 and the inverted second receptacle cover 303 may include one or more open ports 117, 317. In such an embodiment where an open port 117, 317 may be present, the open ports 117, 317 and the raised edges 116, 316 may be aligned in a staggered configuration as shown as shown in FIG. 13. In alternative embodiments, the open ports 117, 317 and/or raised edges 116, 316 may not be positioned in a staggered alignment, but rather aligned with one another. In some embodiments where additional security and stabilization may be desired, the raised edges 116, 316 may connect, snap together or interlock with one another to provide additional resistance to movement and further decrease any sliding by the second receptacle cover 303 over the top surface 105 of the receptacle cover 103.

In some embodiments of the receptacle cover 103 and the raised edge 116 may further include an open port 117 passing through the entire thickness of the raised edge 116. The open port 117 may be any opening, hole, groove or channel capable of passing matter through the raised edge 116. Embodiments of the raised edge 116 may include one open port 117 or the raised edge 116 may include numerous open ports 117 spaced along the raised edge 116. As depicted in the drawings, the open port 117 may in some instances, be a plurality of U-shaped openings that are intermittently spaced along the length of the raised edge 116. The presence one or more open ports 117 along the length of a raised edge 116 may allow for water, snow, dirt and debris to be removed from the top surface 105 of the receptacle cover 103 without catching or being retained by the raised edge 116. For example, a covered receptacle 100 exposed to rain may have a top surface 105 that comes into contact with a series of rain drops landing onto the top surface 105. The sloping direction of the top surface 105 may use the force of gravity to allow the fallen rain drops to slide in the direction of the rear edge 115. Instead of the rain drops collecting at a raised edge 116 located along the rear edge 115, until the rain water collects high enough to spillover, the presence of an open port 117 may allow for the rain to pass through the raised edge 116 at the rear edge 115 (i.e. the lowest point of the downward sloping top surface) and be removed from the top surface 105 immediately, without the rain water collecting on the top surface 105.

Embodiments of the receptacle cover 103 may further comprise an undersurface 107. The undersurface 107 of the receptacle cover 103 may be located on the reverse side or "underside" of the top surface 105. Embodiments of the undersurface 107 may be comprised of the same materials as the top surface and the undersurface 107 may have similar or identical dimensions as the top surface 105. Attached or integrated into the undersurface 107, may be a plurality of legs 109*a*, 109*b*, 111*a*, 111*b* protruding from the undersurface 107, extending downward away from the undersurface 107. Each of the plurality of legs 109*a*, 109*b*, 111*a*, 111*b* may be a column-like protrusion extending downward, providing stability and height for the platform created by the top surface 105. Each of the plurality of legs 109*a*, 109*b*, 111*a*, 111*b* may further provide points of attachment, affixation or abutment between the receptacle cover 103 and the receptacle 101.

The number of legs 109*a*, 109*b*, 111*a*, 111*b* present in a particular embodiment may vary depending on the dimensions and shape of the receptacle 101 that is being affixed to the receptacle cover. For example, embodiments of receptacles 101 that are longer in length or width may have an additional number of legs 109*a*, 109*b*, 111*a*, 111*b* to provide support and stability for the receptacle cover 103, whereas a receptacle 101 that has a smaller length or width comparatively, may not need as many legs 109*a*, 109*b*, 111*a*, 111*b* to support the receptacle cover 103. Likewise, in another example, a receptacle cover 103 fitted for a receptacle 101 having a hexagon shape may have more legs 109*a*, 109*b*, 111*a*, 111*b* present in order to provide additional stability that takes advantage of the six sidewalls of the hexagon shape as opposed to a rectangular receptacle that may only have four sidewalls.

Figure 6:
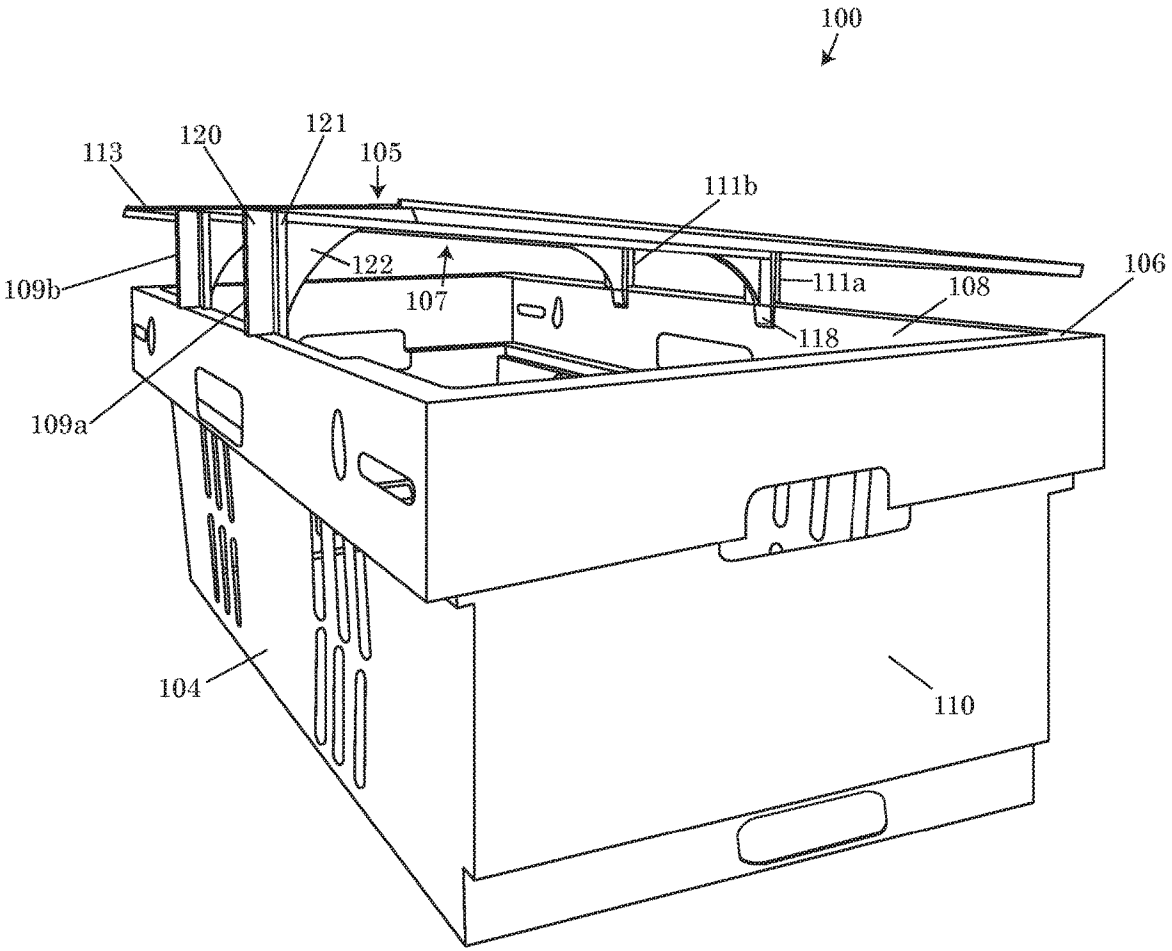
FIG. 6 depicts an isometric side view of an embodiment of a covered receptacle.

As shown in the embodiment of FIG. 6, the legs 109*a*, 109*b*, 111*a*, 111*b* of the receptacle cover 103 may stabilize and secure the receptacle cover 103 to the receptacle 101. As shown in the drawings, the receptacle cover 103 may include a first pair of legs 109*a*, 109*b* extending from the undersurface 107 of the receptacle cover 103 at the first edge 113. Embodiments of the receptacle cover 103 may further include a second pair of legs 111*a*, 111*b* which may be positioned opposite of the first pair of legs 109*a*, 109*b*. Embodiments of the second pair of legs 111*a*, 111*b* may extend from the undersurface 107 of the receptacle cover 103 at the rear edge 115. In some embodiments, the height of first pair of legs 109*a*, 109*b* and the second pair of legs 111*a*, 111*b* may differ. The difference in height may attribute to the degree of slope in the top surface 105 once the legs 109*a*, 109*b*, 111*a*, 111*b* are positioned into place and abut the rim 106 of the receptacle and against each sidewall 104, 108, 110, 112 adjacent to the legs 109*a*, 109*b*, 111*a*, 111*b*. As the differential in height between the first pair of legs 109*a*, 109*b* and the second pair of legs 111*a*, 111*b* increases, the amount of slop observed by the top surface 105 may also increase. As shown by the embodiments of the drawings, the first pair of legs 109*a*, 109*b* may extend above the rim 106 at a height greater than the height of extension of the second pair of legs 111*a*, 111*b* above the rim 106.

In some embodiments of the receptacle cover 103, the height of the legs 109*a*, 109*b*, 111*a*, 111*b* may be adjustable, allowing for the user to set the heights of each pair of legs 109*a*, 109*b*, 111*a*, 111*b*. In other embodiments, the legs 109*a*, 109*b*, 111*a*, 111*b* may be a fixed height. In the exemplary embodiments shown in drawings, the first pair of legs 109*a*, 109*b* positioned at the first edge 113 may have a greater height than the second pair of legs 111*a*, 111*b* located at the rear edge 115 of the receptacle cover 103. The height differential observed may create the slope of the top surface 105. However, in alternative embodiments, the heights of the legs 109*a*, 109*b*, 111*a*, 111*b* may be reversed or the receptacle cover 103 may be universally placed on any of sidewalls of the receptacle 101, causing the top surface 105 to slope in the opposite direction depicted in the drawings.

Referring to FIG. 6, some embodiments of the legs 109*a*, 109*b*, 111*a*, 111*b* may be constructed into a T-shape, comprising a perpendicular section 120 and a parallel section 121. The perpendicular section 120 of the leg 109*a*, 109*b*, 111*a*, 111*b* may be positioned perpendicular to the rim 106 and the sidewall 104, 108, 110, 112 adjacent to the leg 109*a*, 109*b*, 111*a*, 111*b*. The parallel section 121 of leg 109*a*, 109*b*, 111*a*, 111*b* may be positioned parallel to the adjacent sidewall 109*a*, 109*b*, 111*a*, 111*b* and the rim 106 of the adjacent sidewall 104, 108, 110, 112. Embodiments of the perpendicular section 120 and the parallel section 121 of the legs, may intersect one another at a right angle as shown in FIG. 6 (or any other angle between 0° and 180°), wherein an edge of the perpendicular section 120 may touch or be connected to a surface of the parallel section 121.

In the exemplary embodiment, an edge of the perpendicular section 120 of the legs 109*a*, 109*b*, 111*a*, 111*b* may be centered halfway between the width of the abutting surface of the parallel section 121 coming into contact with edge of the parallel section 120, forming a T-shape. Embodiments of the surface of the parallel section 121 adjacent to, or contacting the edge of the perpendicular section 120, may extend a length that may be greater than or equal to the length of the perpendicular section 120 as shown in FIG. 6. In some embodiments, the portion of the parallel section 121 that may extend beyond the length of the perpendicular section 120 may be referred to as a stabilizer foot 118. The stabilizer foot 118 may provide additional stabilization of the receptacle cover 103 to maintain a tight fit between the receptacle cover 103 and the receptacle 101, preventing or reducing an amount wobble by extending the stabilizer foot 118 into the storage compartment 102 and against the interior surface of adjacent sidewall 104, 108, 110, 112. As the receptacle cover 103 is connected to the receptacle 101, the stabilizer foot 118 may slide down the interior surface of the sidewall 104, 108, 110, 112 and force the sidewall 104, 108, 110, 112 to remain in close contact with each adjacent leg of the receptacle cover 103.

Each component of the legs 109*a*, 109*b*, 111*a*, 111*b* may work together to position the height of top surface 105 above the rim 106 of the receptacle 101 while simultaneously ensuring that the top surface 105 of the receptacle cover 103 remains sturdy and in place while the receptacle 101 and receptacle cover are connected. The perpendicular section 120 of the leg 109*a*, 109*b*, 111*a*, 111*b* may extend downward from the undersurface 107 towards a sidewall 104, 108, 110, 112 and rim 106 below the undersurface 107. The width of perpendicular section 120 may make contact with, and rest across, the width of the rim 106 of the adjacent sidewall 104, 108, 110, 112 as shown in FIG. 6. The rim 106 may act as a ledge to support the perpendicular section 120 of the leg, allowing for the legs 109*a*, 109*b*, 111*a*, 111*b* to extend above the rim and prop up the top surface 105 and undersurface 107 of the receptacle cover 103.

While the perpendicular section 120 of the leg 109*a*, 109*b*, 111*a*, 111*b* may be utilizing the rim 106 of the sidewalls 104, 108, 110, 112 for structural support, the parallel section 121 extend downward from the undersurface 107 parallel to, and abutting against the adjacent sidewalls 104, 108, 110, 112. By extending from the undersurface 107 into the storage compartment and abutting against the adjacent sidewalls 104, 108, 110, 112, the legs 109*a*, 109*b*, 111*a*, 111*b* may be snuggly fit against the sidewalls to limit the amount of shifting or movement that may occur, thus stabilizing the top surface 105 and holding the receptacle cover 103 in place above the rim 106.

In some embodiments, the parallel section 121 may further include an arching support 122. The arching support 122 connected to each of the parallel sections 121 of the legs 109*a*, 109*b*, 111*a*, 111*c* may provide additional strength and support for holding the top surface 105 and undersurface 107 securely above each of the legs and limit, reduce or eliminate any bowing that may occur in the center of the receptacle cover 103.

Figure 7:
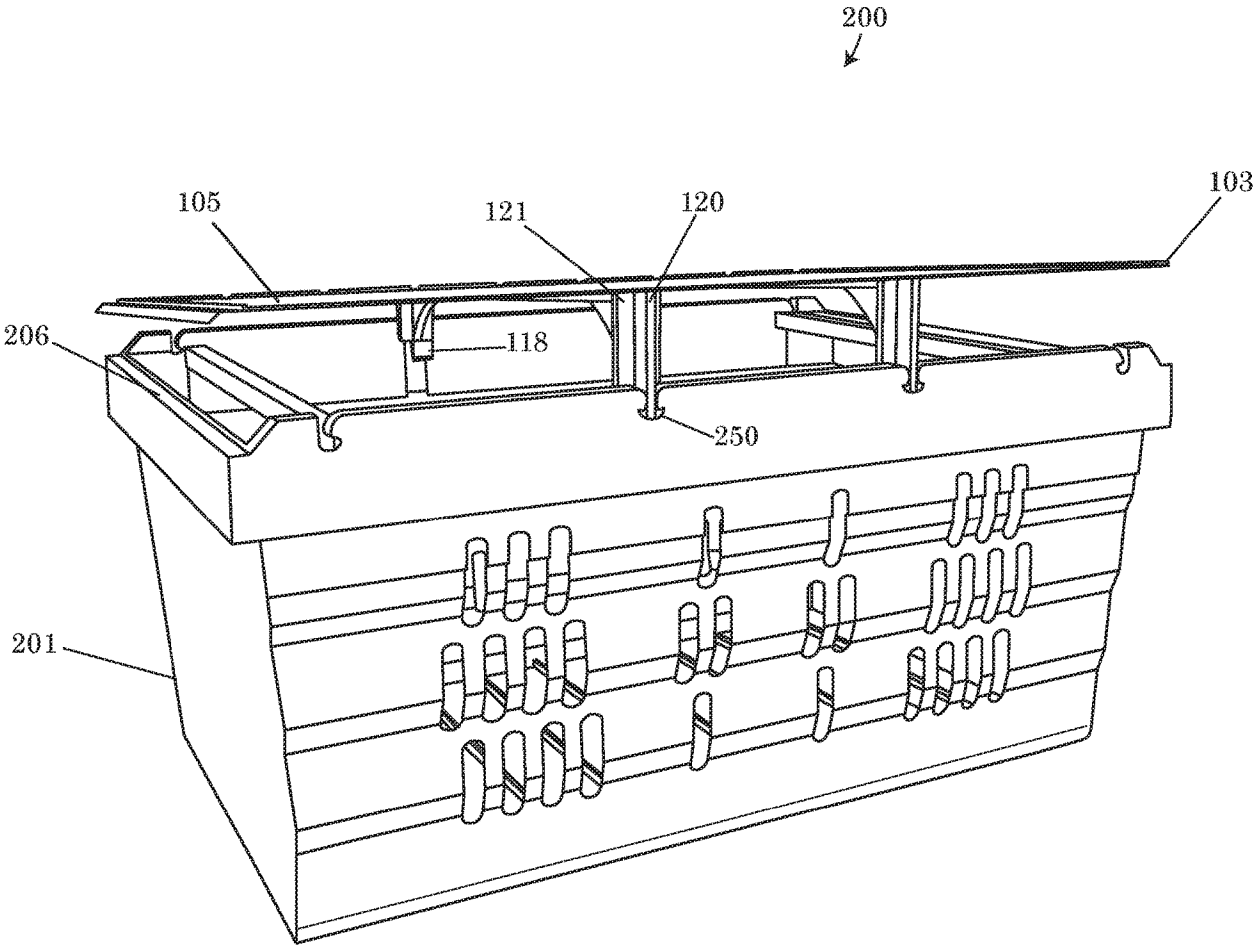
FIG. 7 depicts an isometric front view of an alternative embodiment of a covered receptacle.
Figure 9:
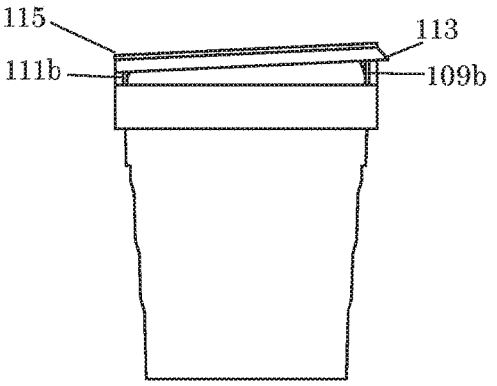
FIG. 9 depicts a left side view of the embodiment of the covered receptacle of FIG. 7.
Figure 11:
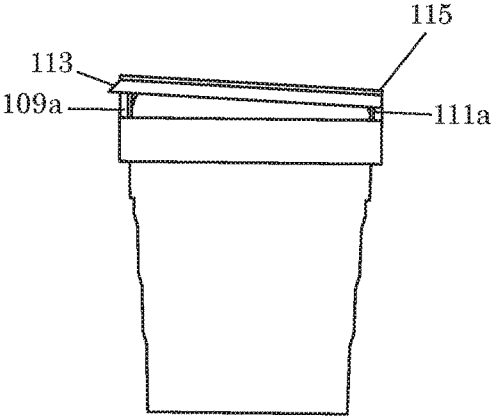
FIG. 11 depicts a right side view of the embodiment of the covered receptacle of FIG. 7.
Figure 8:
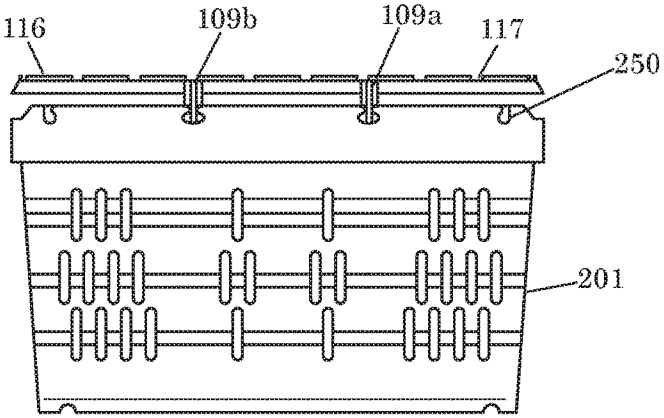
FIG. 8 depicts a front view of the embodiment of the covered receptacle of FIG. 7.
Figure 10:
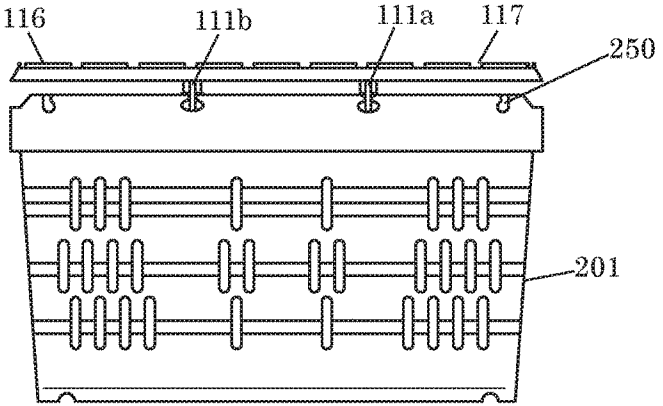
FIG. 10 depicts a rear view of the embodiment of the covered receptacle of FIG. 7.

In alternative embodiments of the covered receptacle system 200, the receptacle cover 103 may attach or be affixed into an alternative receptacle 201. Embodiments of the alternative receptacle 201 may include a modified rim 206 having one or more slots 250 extending vertically from the rim 206 into the adjacent sidewall of the alternative receptacle 201. As shown in FIG. 7 of the current application, the slots 250 may extend vertically from the rim 316 into the front sidewall and/or rear sidewall where a portion of each of the pairs of legs 109*a*, 109*b*, 111*a*, 111*b* may mate with the plurality of slots 250.

Embodiments of the receptacle cover 103 may utilize the structure of slots 250 to provide additional support to the receptacle cover 103 when attaching the legs 109*a*, 109*b*, 111*a*, 111*b* to the receptacle 201. For example, when the cover 103 is being affixed to the alternative receptacle 201, the perpendicular section 120 of the legs 109*a*, 109*b*, 111*a*, 111*b* may slide into the slot 250 of the rim 206 instead of resting on top of the rim 206 as previously discussed above. The perpendicular sections 120 may use the bottom portion of the slot as a ledge while the sidewalls of the slot 250 may abut against the surface of the perpendicular section 120 creating a tight connection, further stabilizing the leg 109*a*, 109*b*, 111*a*, 111*b* entering the slot and reducing the amount of movement that may be experienced by the receptacle cover 103.

Method for Covering a Receptacle

Embodiments of methods for covering a receptacle 101, 301 may be performed using one or more of the embodiments of the receptacle covers 103 described above and as pictured in the accompanying figures. In the first step of the method, a receptacle 101, 301 may be provided. The receptacle may contain one or more items stored in the storage compartment 102 in some embodiments. In other embodiments of the method, the storage compartment 102 of the provided receptacle 101, 301 may be provided empty and the items or products may be subsequently added to the storage compartment 103 after assembling the receptacle cover 103 onto the receptacle 101, 301.

Embodiments of the method for covering receptacle 101, 301 may further comprise a step of providing a receptacle cover 103 having one or more of the features or elements described above. For example, the receptacle cover 103 being provided may include a top surface 105, an undersurface 107, a first pair of legs 109*a*, 109*b* and a second pair of legs. Each pair of legs may be extending downward from the undersurface 107. In the next step of the method, the method may include a step of abutting, affixing or connecting the first pair of legs 109*a*, 109*b* against the rim 106, 206 of the adjacent sidewall, such as a front sidewall 104 and abutting or affixing the second pair of legs against the rim 106, 206 of the adjacent sidewall, such as rear sidewall 108.

The step of abutting the first pair of legs 109*a*, 109*b* and the second pair of legs 111*a*, 111*b* against the adjacent sidewalls 104, 108, 110, 112 may be performed simultaneously or nearly simultaneously. The abutting step may be performed by positioning the receptacle cover 103 over the receptacle 101, 201 and aligning the perpendicular section 120 of each leg 109*a*, 109*b*, 111*a*, 111*b* above a corresponding sidewall 104, 108, 110, 112. The step of abutting the first pair of legs 109*a*, 109*b* against the receptacle 101, 301 and the receptacle's sidewalls 104, 108, 110, 112 may further include aligning the parallel section 121 of each leg 109*a*, 109*b*, 111*a*, 111*b* in such an orientation that the interior surface of the parallel section 121 and/or the interior surface of the stabilizer 118 may make contact with rim 106, 306 and/or the interior surface of the adjacent sidewalls forming the storage compartment 102.

In the next step of the method, subsequently applying pressure to the receptacle cover 103, the first pair of legs 109*a*, 109*b* and second pair of legs 111*a*, 111*b* may slide the legs 109*a*, 109*b*, 111*a*, 111*b* into a proper position wherein the perpendicular section 120 of each pair of legs 109*a*, 109*b*, 111*a*, 111*b* firmly abuts the rim 106, 206 of the receptacle 101, 201. Moreover, in addition to the abutment of the perpendicular section 120 against the rim 106, 206 during the step of applying pressure, the parallel section 121 and stabilizer 118 may simultaneously slide downward into position from the initial orientation position adjacent to the rim 106, 206 and/or interior surface of the adjacent sidewall, down into the storage compartment 102. Firmly securing the parallel section 121 and stabilizer 118 against the interior surface of each adjacent sidewall, for example the front sidewall 104 and rear sidewall 108. Thus, stabilizing the receptacle 103, resisting any movement or separation of the receptacle cover 103 from the receptacle 101, 201 and further utilizing the sidewalls 104, 108, 110, 112 and the rim 106, 206 of the receptacle 101, 201 for both structural support of the receptacle cover 103, providing a platform for each leg 109*a*, 109*b*, 111*a*, 111*b* to be raised above the rim 106, 206 of the receptacle 101, 201, thus providing ample space between the undersurface 107 and the rim 106, 206, allowing for products and items to extend above the rim 106, 206. In some embodiments, the method steps of abutting or affixing the receptacle cover 103 to a receptacle 101, 201 may further include a step of aligning the perpendicular section 120 of each leg above one or more slots 250 and applying a downward pressure to the receptacle cover 103, sliding the perpendicular section 120 of the leg in between the slot 250.

In some embodiments, the method for covering the receptacle 101, 201 may further include a step of removing unwanted environmental hazards such as water or snow from the top surface 105 of the receptacle cover 103. Embodiments of the method including the removal of an environmental hazard may include a step of receiving an unwanted environmental hazard, wherein the step of receiving includes the environmental hazard making contact with the top surface 105 of the receptacle cover 103. Subsequently, upon making contact with the top surface 105, the environmental hazard may proceed by moving from the point of contact on the top surface 105 to the rear edge 115 of the top surface 105, following the downward sloping angle of the top surface 105 until the environmental hazard reaches the rear edge 115. Upon reaching the rear edge, the environmental hazard may continuously move past the rear edge 115, ejecting itself from the top surface in a direction leading away from the receptacle 101, 201 or the storage compartment 102 and preventing the environmental hazard such as snow, water, ice, etc. from entering the storage compartment 112.

In some embodiments, wherein a raised edge 116 may be affixed to the rear edge 115 of the receptacle 101, 201, the method may further include a step of aggregating the environmental hazard at the interior surface of the raised edge 116 until the height of the aggregated environmental hazard is greater than the height of the raised edge 116, allowing for the environmental hazard to eject from the top surface 105 over the side of the raised edge 116. In an embodiment of the method for covering a receptacle 101, 201, wherein the raised edge 116 further comprises an open port 117, the environmental hazard may proceed to eject itself from the top surface by passing through the open port 117 and upon exiting the open port 117, ejecting the environmental hazard from the top surface of the receptacle cover 103 in a direction away from the receptacle 101, 201 or the storage compartment 102.

In some embodiments of the method for covering a receptacle 101, 201, the method may further comprise step of providing a second receptacle cover 303, inverting the orientation of the receptacle cover 303 and positioning the second receptacle cover 303 on top of the receptacle cover 303. The friction of the inverted receptacle cover 303 on top of the top surface 105 of the receptacle cover 103 may prevent the inverted receptacle cover 303 from sliding or being removed from the top surface 105. In some embodiments wherein the receptacle cover 103 and/or the inverted receptacle cover 303 comprise a raised edge 116, 316, the method may further comprise the step of positioning each of the raised edges 116, 316 against one another. Moreover, in some embodiments, the embodiments of the method may further comprise attaching or connecting each of the raised edges 116, 316.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed:

1. A covered receptacle system comprising:

a receptacle having a storage compartment formed by a front sidewall, a rear sidewall and a rim formed along a perimeter of a top of the storage compartment of the receptacle;

a receptacle cover comprising a top surface, an undersurface, a first pair of legs and a second pair of legs, wherein the first pair of legs and the second pair of legs extend downward from the undersurface of the receptacle cover; and a plurality of slots extending vertically from the rim into the front sidewall and the rear sidewall, wherein a portion of the first pair of legs and a portion of the second pair of legs mate with each of the plurality of slots; wherein:

the first pair of legs are positioned adjacent to the rim at the front sidewall, wherein the first pair of legs extend above the rim;

the second pair of legs are positioned adjacent to the rim at the rear sidewall, wherein the second pair of legs extend above the rim; and the top surface of the receptacle cover slopes at a downward angle.

2. The covered receptacle system of claim 1, further comprising a raised edge extending from the top surface of the receptacle cover.

3. The covered receptacle system of claim 2, wherein the raised edge further comprises an open port passing through the raised edge.

4. The covered receptacle system of claim 3, wherein the raised edge is positioned at a lowest point of the downward angle of the top surface.

5. The covered receptacle system of claim 1, further comprising:

the top surface having a raised edge with a plurality of open ports;

the first pair of legs and the second pair of legs are T-shaped, wherein the T-shape of each of the first pair of legs and the second pair of legs comprises a perpendicular section affixed into each of the plurality of slots of the rim and a parallel section positioned parallel to the front sidewall or rear sidewall; and the parallel section of the first pair of legs and the second pair of legs each contact an interior surface of the front sidewall or rear sidewall, wherein a length of the parallel section is longer than a length of the perpendicular section and the parallel section extends into the storage compartment of the receptacle.

6. A receptacle cover comprising:

a top surface;

an undersurface;

a first pair of legs extending downward from the undersurface at a front edge of the undersurface; and a second pair of legs extending downward from the undersurface at a rear edge of the undersurface, wherein the second pair of legs are shorter in length than the first pair of legs, and wherein the first pair of legs and the second pair of legs are an adjustable length.

7. The receptacle cover of claim 6 further comprising:

a raised edge extending upward from the top surface of the receptacle cover.

8. The receptacle cover of claim 7, wherein the raised edge is positioned at a rear edge of the top surface.

9. The receptacle cover of claim 7, wherein the raised edge further comprises at least one open port passing through the raised edge.

10. The receptacle cover of claim 6, wherein the top surface slopes at a downward angle from a front edge of the top surface to a rear edge of the top surface.

* * * * *